US005759762A

United States Patent [19]

Budz et al.

[11] Patent Number: 5,759,762

[45] Date of Patent: Jun. 2, 1998

[54] HIGH CHLORIDE EMULSION WITH DIMETHYLAMINE SILVER CHLORO-IODIDE AND ANTIFOGGANTS

[75] Inventors: Jerzy A. Budz, Fairport; Seshadri Jagannathan; Tommie L. Royster, Jr., both of Rochester, all of N.Y.

[73] Assignee: Eastman Kodak Company, Rochester, N.Y.

[21] Appl. No.: 866,577

[22] Filed: May 30, 1997

[51] Int. Cl.[6] ..... G03C 1/34

[52] U.S. Cl. ..... 430/611; 430/569; 430/607

[58] Field of Search ..... 430/569, 607, 430/611

[56] References Cited

U.S. PATENT DOCUMENTS

| | | | |
|---|---|---|---|
| 1,962,133 | 6/1934 | Brooker et al. | 430/611 |
| 2,440,110 | 4/1948 | Mueller | 430/611 |
| 2,465,149 | 3/1949 | Dersch et al. | 430/611 |
| 5,217,859 | 6/1993 | Boettcher et al. | 430/607 |
| 5,219,721 | 6/1993 | Klaus et al. | 430/607 |
| 5,328,820 | 7/1994 | Klaus et al. | 430/611 |
| 5,418,127 | 5/1995 | Budz et al. | 430/611 |
| 5,654,134 | 8/1997 | Morimura et al. | 430/611 |

*Primary Examiner*—Hoa Van Le
*Attorney, Agent, or Firm*—Arthur H. Rosenstein

[57] ABSTRACT

A solution containing a dimethylamine silver chloro-iodide complex is added with an antifoggant to a silver chloride emulsion to form a stable AgICl emulsion.

5 Claims, No Drawings

HIGH CHLORIDE EMULSION WITH DIMETHYLAMINE SILVER CHLORO-IODIDE AND ANTIFOGGANTS

FIELD OF THE INVENTION

This invention relates to the precipitation process of silver chloride crystals. In particular, it relates to the combination of a unique silver chloro-iodide complex contained in a dimethylamine solution and certain antifoggants that can be used as single source material for precipitation of silver chloride crystals having high keeping stability.

BACKGROUND OF THE INVENTION

Silver halide emulsions are generally prepared using a reactive precipitation process; aqueous solutions of silver nitrate and alkali halides are reacted in the presence of gelatin. The composition of resultant product (silver halide emulsions) is tuned by varying the constituents of the alkali halide solution. For example, the precipitation of pure silver bromide emulsions is carried out using sodium bromide as the alkali halide, while silver chloride emulsions are precipitated using sodium chloride as the alkali halide. Appropriate addenda/dopants are generally introduced as aqueous solutions during the precipitation process, to generate silver halide emulsions of desired composition and photographic performance.

The important feature of all these processes is the bimolecular chemical reaction between (Ag+) ions and the appropriate anion(s) to generate the precipitating species. It is possible to vary the chemical and the structural composition of the product emulsion by varying the constituents of the reagent solutions, but the chemical reaction responsible for the generation of the desired silver halide emulsion is always the reaction between (Ag+) ions that are present in a solution or on the surface of the silver halide emulsion, and the appropriate anion(s).

From an operational point of view, generation of silver halide emulsions by this reactive precipitation process involves the addition of concentrated reagent solutions into a reactor under vigorous mixing conditions. The goal of the mixing process is to minimize the volume of the reactor that is exposed to the unreacted reagent solutions. However, even under ideal mixing conditions, the volume of the reactor that is exposed to the unreacted reagents is finite and relatively large.

In order to understand the reasons for the exposure of the reactor contents to unreacted reagents it is necessary to examine the mechanism of the mixing process. Mixing in emulsion precipitation processes is achieved by means of a rapidly spinning rotary agitator. The momentum generated by the rotary agitator results in the circulation of the fluid in the reactor. Appropriate baffling devices are used to randomize the fluid motion in the reactor, to achieve efficient mixing. It is important to recognize that efficient mixing requires rapid circulation of the fluid in thereafter. In a typical emulsion generation process, the reagent solutions are introduced into a region of the reactor that experiences good mixing. Consequently, the concentrated reagent solutions are introduced into a region of the reactor that experiences rapid circulation of the fluid in the reactor; i.e. the reagent introduction region in the reactor is exposed frequently to the contents of the reactor.

It is important to recognize that efficient mixing is necessary at the reagent introduction region, in order to promote the reaction between the concentrated reagents. Because this (efficient) mixing process is carried out by rapid circulation of the reactor fluid through the reagent introduction region, the contents of the reactor are necessarily exposed to the concentrated reagents. From a kinetic view point, the extent of exposure of the reactor contents to the unreacted reagents would depend on the rate of dilution of the concentrated reagents relative the rate of the chemical reaction between the concentrated reagents. Under ideal mixing conditions, the rate of dilution of the concentrated reagents is determined by the molecular/ionic diffusivity of the reactant species; which is still considerably smaller than the rate of the relevant chemical reactions. Hence, the extent of exposure of the reactor contents to the unreacted reagents can be significant even under ideal mixing conditions.

The unintentional exposure of the reactor contents to the unreacted reagents can have undesired effects on the emulsion crystals. For example, exposure of emulsion crystals to unreacted silver nitrate can result in the creation of fog centers in the crystals, while exposure of emulsion crystals to unreacted concentrated, potassium iodide can result in the generation of exploded grains. The generation of exploded grains can be avoided by using dilute solutions of potassium iodide, solutions of iodide that also contain sodium bromide and long addition times. The disadvantages of this approach is the large volume of the reagents and the extension of the precipitation time (yield and productivity).

An alternative to the above approach is the use of silver iodide dissolved in an appropriate solvent as the source of iodide.

Halide introduction from concentrated solutions of silver halide complexes prepared from methylamineformamide and excess halide have been reported. However, methylamineformamide is exceedingly hazardous and the solvent has been documented as a tetratogen (promotes deformity in embryos).

The advantages of the use of dimethylamine silver chloro-iodide as a source of iodide and the process of its incorporation during emulsion precipitation are described in copending U.S. patent applications Ser. No. 08/866,853, entitled, "Preparation And Use Of Dimethylamine Silver Chloro-Iodide Complex As A Single Source Precursor For Iodide Incorporation In Silver Chloride Crystals" by Royster et al and Ser. No. 08/866,785, entitled, "Preparation And Use Of A Dimethylamine Silver Chloride Complex As A Single Source Precursor For Nucleation Of Silver Chloride Crystals" by Royster et al each filed concurrently herewith.

Silver halide emulsions having high chloride contents, i.e. greater than 50 mole percent chloride based on silver, are known to be very desirable in image-forming systems due to the high solubility of silver chloride which permits short processing times and provides less environmentally polluting effluents. Unfortunately, it is very difficult to provide a high chloride silver halide emulsion having the high sensitivity desired in many image-forming processes and high stability on keeping.

One of the methods of improving inherent speed of silver chloride emulsions known in the art is to augment such emulsions with small amounts of iodide, as described for example in U.S. application Ser. No. 08/601,642, filed 14 Feb. 1996, entitled, "Digital Imaging With High Chloride Emulsions Containing Iodide" by Budz et al.

High speed silver chloride emulsions are prone to fogging. Many useful antifoggants are known in the art. Of particular interest are those compounds that are water-soluble and active in silver chloride emulsions designed for rapid access processes, e.g., RA-4. Water soluble disulfides are known to be useful antifoggants as described in U.S. Pat.

No. 5,418,127. An example of such a compound is water soluble para-glutaramidophenyl disulfide, thereafter referred to as GDPD. These disulfides can be used at any stage of emulsion preparation, e.g., during precipitation, wash, chemical/spectral sensitization and post-ripening processes.

SUMMARY OF THE INVENTION

It was found that, unexpectedly, when $[Me_2NH_2]_n[AgICl_n]$ is used as an iodide source in silver chloride emulsions that contained antifoggants such as water soluble disulfides for fog control (added during treatment with $[Me_2NH_2]_n[AgICl_n]$ AgI or afterward), the raw stock keeping properties of these emulsions are better than when either of the above compounds is used separately. Thus, the invention comprises the method of incorporation of iodide into silver chloride emulsions by introducing $[(CH_3)_2NH_2]_n[AgICl_n]$ (n is from 1 to 5) into a silver chloride emulsion and contacting the silver halide emulsion with an antifoggant.

DETAILED DESCRIPTION OF THE PREFERRED EMBODIMENTS

This invention depends on the preparation of a silver chloro-iodide complex as a precursor to the formation of silver iodide for incorporation in silver chloride crystals. The complex $[Me_2NH_2]_n[AgICl_n]$ wherein n is 1 to 5, contained in solid or liquid hydrated $[Me_2NH_2]Cl$ provides a single source material for silver iodide precipitation. Preparation of the material can be accomplished by combining silver iodide with hydrated $[Me_2NH_2]Cl$ or dissolving the isolated complex $[Me_2NH_2][AgICl]$ in the hydrated salt.

i)

$$AgI \xrightarrow{[Me_2NH_2]Cl} [Me_2NH_2]_n[AgICl_n]$$

ii)

$$[Me_2NH_2][AgICl] \xrightarrow{[Me_2NH_2]Cl} [Me_2NH_2]_n[AgICl_n]$$

This invention uses the materials prepared by the above process to incorporate silver iodide into silver chloride crystals. Iodide incorporation is accomplished by introducing the hydrated $[Me_2NH_2]Cl$ that contains the precursor complex into an aqueous medium of silver chloride crystals.

$$[Me_2NH_2]_n[AgICl_n] \xrightarrow{H_2O} AgI\Big\downarrow + n[Me_2NH_2]Cl$$

Thus, an amine salt $[(CH_3)_2NH_2]Cl$ can be hydrated with water and silver iodide can be introduced to form $[Me_2NH_2]_n[AgICl_n]$ or the amine salt can be combined with silver iodide in a dimethylformamide (DMF) solvent and heated to form crystals of the complex $[(CH_3)_2NH_2][AgICl]$ which are dissolved in hydrated $[Me_2NH_2]Cl$. Alternatively, concentrated HCl can be substituted for $[(CH_3)_2NH_2]Cl$ as the chloride source. The silver halide crystals involved are prepared using $[(CH_3)_2NH_2]_n[AgICl_n]$ as the source of iodide to form silver chloro iodide crystals.

The present invention involves the stabilization of the particular resulting AgICl emulsion by the incorporation of an antifoggant.

The present invention is directed to the introduction of an antifoggant to the resulting AgICl emulsion which has been found to unexpectedly enhance the keeping of the crystals in the AgICl emulsion.

Examples of useful antifoggants for the purposes of the invention are water-soluble disulfides as described by the general formula.

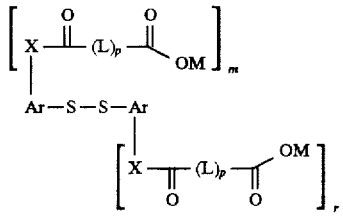

wherein

X is independently —O—, —NH— or —NR—, where R is a substituent;

m and r are independently 0, 1 or 2;

M is —H or a cationic species;

Ar is an aromatic group; and

L is a linking group, where p is 0 or 1

Preferred water-soluble disulfides are para-glutaramidophenyl disulfide, disodium salt, ortho-succidaminophenyl disulfide disodium salt and the like.

The preferred amount of antifoggant which can be added during or after adding the iodide to the silver chloride emulsion is from 1 to 100 mg/per mole of silver halide.

The invention can be better appreciated by reference to the following Examples.

EMULSION PREPARATION

Example 1

A reaction vessel containing 3.5 L of a solution that was 4.3% of gelatin, 21 grams of NaCl, 26 mg of para-glutaramidophenyl disulfide (GDPD) and 0.25 mL of Nalco 2341 antifoaming agent. The contents of the reaction vessel were maintained at 68° C., and the pCl was adjusted to 1.0. To this stirred solution at 68° C. was added simultaneously and at 75 mL/min each 2.1.0M $AgNO_3$ and 2.5M NaCl solutions over 12.76 minutes. NaCl solution contained osmium dopant. Then these solutions were added at ramped flow from 75 to 142 mL/min over 30 minutes. Finally the emulsion was cooled down to 43° C. over 8 minutes. The resulting emulsion was a cubic grain silver chloride emulsion of 0.708 μm in edge length size. The emulsion was then washed using an ultrafiltration unit, and its final pH and pCl were adjusted to 5.6 and 1.8, respectively.

Example 2

This emulsion was precipitated exactly as in Example 1, except no GDPD was added to the kettle and small amount of $HgCl_2$ was added to silver nitrate. The resulting emulsion was cubic grain silver chloride emulsion of 0.753 μm in edge length size.

Example 3

The emulsion from Example 1 was treated with $[Me_2NH_2]_n[AgICl_n]$ so, that 0.3% of iodide was introduced into the grains, using the following procedure:

Approximately 3 moles of the substrate (emulsion from example 1) was redispersed in 7.5 kg of water containing ca. 80 g of sodium chloride water and heated to 70° C. with mixing. To this solution, 100 ml of a solution containing 1.1 g of potassium iodide and 30 g of sodium chloride was added by a rapid surface dump process and the mixture was held at 70° C. for 5 minutes with stirring. Subsequent to the hold period, a 4M solution of silver nitrate was added to the emulsion at a rate of 10 cc/min for 6.5 minutes. The final emulsion was cooled to 40° C., washed and concentrated to a final pH of 5.56 and pCl of 1.39, and characterized by EGA to have an effective cubic edge length of ca. 0.78 microns. The iodide content of the emulsion is calculated to be ca. 0.2%.

Example 4

The emulsion from Example 2 was treated with $[Me_2NH_2]_n[AgICl_n]$ so, that 0.3% of iodide was introduced into the grains, using the procedure described in Example 3 above.

Example 5

The emulsion from Example 1 was melted at 40° C. and GDPD was added to the emulsion melt at 20 mg/silver mole. Subsequently, the optimum amount of colloidal gold-sulfide was added and then a blue sensitizing dye followed by heat digestion at 55° C. for 40 minutes. After cooling down to 40° C. 1-(3-acetomidophenyl)-5-mercaptotetrazole was added.

Example 6

The emulsion from Example 3 was sensitized as in Example 5, except that GDPD was not used in the finish.

Example 7

The emulsion from Example 3 was sensitized exactly as in Example 5.

All emulsions were coated at 26 mg silver per square foot on resin-coated paper support. The coatings were overcoated with gelatin layer and the entire coating was hardened with bis(vinylsulfonylmethyl)ether.

Coatings were exposed by a gradation exposure tablet with white light at 1/10 second and then processed in Kodak™ Ektacolor RA-4 processing. Photographic speed was measured at density=1.0. In addition Ar+ gas laser (476 nm at pixel time=1 μsec) exposures were used and laser speed was measured at density=2.0.

TABLE I

Sensitometric Results
Treatment with $[Me_2NH_2]_n[AgICl_n]$

| Example | Treatment with $[Me_2NH_2]_n[AgICl_n]$ | GDPD in finish | Dmin | Optical Speed | Laser Speed | ΔDmin 2 wk/120° F. | ΔSpeed 2 wk/120° F. |
|---|---|---|---|---|---|---|---|
| 5 | no | yes | 0.057 | 102.5 | 69.5 | 0.069 | +12.0 |
| 6 | yes | no | 0.072 | 114.3 | 94.9 | 0.013 | +21.0 |
| 7 | yes | yes | 0.061 | 114.5 | 94.9 | 0.011 | +15.1 |

Example 8

The emulsion from Example 2 was melted at 40° C. and then GDPD was added to the emulsion melt at 20 mg/silver mole. Subsequently, the optimum amount of colloidal gold-sulfide was added and then a blue sensitizing dye followed by heat digestion at 55° C. for 40 minutes. After cooling down to 40° C. 1-(3-acetomidophenyl)-5-mercaptotetrazole was added.

Example 9

The emulsion from Example 4 was sensitized as in Example 5, except no GDPD was used in the finish.

Example 10

This emulsion from Example 4 was sensitized exactly as in Example 5.

All emulsions were coated at 26 mg silver per square foot on resin-coated paper support. The coatings were overcoated with gelatin layer and the entire coating was hardened with bis(vinylsulfonylmethyl)ether.

Coatings were exposed gradation exposure table with white light at 1/10 second and then processed in Kodak™ Ektacolor RA-4 processing. Photographic speed was measured at density=1.0. In addition Ar+ gas laser (476 nm at pixel time=1 μsec) exposures were used and laser speed was measured at density=2.0

TABLE II

Sensitometric Results
Treatment with $[Me_2NH_2]_n[AgICl_n]$

| Example | Treatment with $[Me_2NH_2]_n[AgICl_n]$ | GDPD in finish | Dmin | Optical Speed | Laser Speed | ΔDmin 2 wk/120° F. | ΔSpeed 2 wk/120° F. |
|---|---|---|---|---|---|---|---|
| 8 | no | yes | 0.055 | 113.0 | 84.0 | 0.045 | +15.9 |
| 9 | yes | no | 0.057 | 113.9 | 97.9 | 0.015 | +20.7 |
| 10 | yes | yes | 0.058 | 113.8 | 103.3 | 0.009 | +13.1 |

The above examples show unique emulsions treated with $[Me_2NH_2]_n[AgICl_n]$ and containing antifoggants are stable on keeping with efficiency specifically useful at short time exposures, as used in direct digital printing onto silver chloride papers.

While the invention has been described with particular reference to a preferred embodiment, it will be understood by those skilled in the art the various changes can be made and equivalents may be substituted for elements of the preferred embodiment without departing from the scope of the invention. In addition, many modifications may be made to adapt a particular situation in material to a teaching of the invention without departing from the essential teachings of the present invention.

We claim:

1. The method of treating AgICl emulsions with $[(CH_3)NH_2]_n[AgICl]_n$ wherein in n is 1 to 5, containing water soluble disulfides.

2. The method of claim 1 wherein the water soluble disulfide is para-glutaramidophenyl disulfide (GDPD).

3. The method of claim 1 wherein the water soluble disulfide is added during the treatment with $[(CH_3)NH_2]_n[AgICl]_n$.

4. The method of claim 3 wherein the antifoggant is added after treatment with $[(CH_3)_2NH_2]_n[AgICl]_n$.

5. The method of claim 1 wherein the water soluble disulfide comprises 1 to 100 mg/mole of the silver halide.

* * * * *